US005513953A

United States Patent [19]

Hansen

[11] Patent Number: 5,513,953

[45] Date of Patent: May 7, 1996

[54] SUSPENDED CEILING FAN

[76] Inventor: Clint W. Hansen, 516th 5th St., Traer, Iowa 50675

[21] Appl. No.: 304,886

[22] Filed: Sep. 13, 1994

[51] Int. Cl.[6] ..... F04D 29/40

[52] U.S. Cl. ..... 415/183; 415/211.2; 415/213.1; 415/223; 454/300

[58] Field of Search ..... 415/58.4, 58.5, 415/58.6, 58.7, 183, 208.1, 211.2, 213.1, 223, 224; 454/292, 300, 230, 205

[56] References Cited

U.S. PATENT DOCUMENTS

| | | | |
|---|---|---|---|
| 2,021,086 | 11/1935 | Oskamp | 415/223 |
| 2,378,012 | 6/1945 | Herbster | 415/211.2 |
| 2,583,374 | 1/1952 | Hoffman | 415/211.2 |
| 2,636,668 | 4/1953 | Meyer et al. | 415/211.2 |

FOREIGN PATENT DOCUMENTS

| | | | |
|---|---|---|---|
| 63-29146 | 2/1988 | Japan | 454/292 |
| 2-103331 | 4/1990 | Japan | 454/292 |

*Primary Examiner*—Edward K. Look
*Assistant Examiner*—James A. Larson

[57] ABSTRACT

A suspended ceiling fan assembly comprising: a housing having a central section in a generally dome-shaped configuration with a first axis and with an external periphery formed as a square, the periphery including a wall extending from the periphery of the dome-shaped component and, at its end, inturned ledges in a rectangular configuration, the ledges adapted to be supported upon the periphery opening; a fan supported by the center of the housing and extending therefrom, the fan having a motor with a circular cross-section about an axis of rotation coincident with the axis of the housing, the fan including a plurality of blades secured to the motor for rotation in a plane about the axis of rotation of the motor; and a plurality of louvers to spread out air forced outwardly by the rotation of the fan blades.

3 Claims, 4 Drawing Sheets

SUSPENDED CEILING FAN

BACKGROUND OF THE INVENTION

1. Field of the Invention

The present invention relates to suspended ceiling fan and more particularly pertains to supporting a ceiling fan in a panel of a suspended ceiling.

2. Description of the Prior Art

The use of ceiling fans of a wide variety of designs and configurations is known in the prior art. More specifically, ceiling fans of a wide variety of designs and configurations heretofore devised and utilized for various purposes are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,693,673 a ceiling fan.

U.S. Pat. No. 5,054,376 discloses an electric ceiling fan.

U.S. Pat. No. 5,154,579 disclose a ceiling fan assembly.

U.S. Pat. No. 5,222,864 discloses another type of ceiling fan.

U.S. Pat. No. Des. 332,232 discloses the design of a ceiling fan.

In this respect, the suspended ceiling fan according to the present invention substantially departs from the conventional concepts and designs of the prior art, and in doing so provides an apparatus primarily developed for the purpose of supporting a ceiling fan in a panel of a suspended ceiling.

Therefore, it can be appreciated that there exists a continuing need for new and improved suspended ceiling fan which can be supported in a panel of a suspended ceiling. In this regard, the present invention substantially fulfills this need.

SUMMARY OF THE INVENTION

In view of the foregoing disadvantages inherent in the known types of ceiling fans of a wide variety of designs and configurations now present in the prior art, the present invention provides an improved suspended ceiling fan. As such, the general purpose of the present invention, which will be described subsequently in greater detail, is to provide a new and improved suspended ceiling fan and method which has all the advantages of the prior art and none of the disadvantages.

To attain this, the present invention essentially comprises a new and improved suspended ceiling fan assembly comprising, in combination: a housing having an upper central section in a generally dome-shaped configuration with a vertical axis and an external periphery formed as a square, the periphery including a vertical wall extending downwardly from the periphery of the central section and, at its lower end, inturned horizontal ledges in a rectangular configuration, the ledges adapted to be supported upon the peripheral opening of a panel in a drop ceiling; a fan supported by the center of the housing and extending downwardly therefrom, the fan having a motor with a circular cross-section about a vertical axis of rotation coincident with the axis of the housing, the fan including a plurality of blades secured to the motor for rotation in a horizontal plane about the axis of rotation of the motor; a plurality of circular louvers positioned radially outwardly from the central section of the housing with curvatures curved about an axis of rotation beneath the housing to spread out air forced downwardly by the rotation of the fan blades; and a plurality of radially extending vertically disposed planar ribs coupled between the motor and the periphery of the housing to define beneath the housing a path of travel for air from the room to enter and move to a location above the fan blades for being blown downwardly by the fan blades into the room therebeneath in an air recirculation mode.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved suspended ceiling fan which has all the advantages of the prior art ceiling fans and none of the disadvantages.

It is another object of the present invention to provide a new and improved suspended ceiling fan which may be easily and efficiently manufactured and marketed.

It is further object of the present invention to provide a new and improved suspended ceiling fan which is of a durable and reliable construction.

An even further object of the present invention is to provide a new and improved suspended ceiling fan which is susceptible of a low cost of manufacture with regard to both materials and labor, and which accordingly is then susceptible of low prices of sale to the consuming public, thereby making such suspended ceiling fan economically available to the buying public.

Still yet another object of the present invention is to provide new and improved suspended ceiling fan which provides in the apparatuses and methods of the prior art some of the advantages thereof, while simultaneously overcoming some of the disadvantages normally associated therewith.

Still another object of the present invention is to support a ceiling fan in a panel of a suspended ceiling.

Lastly, it is an object of the present invention to provide a new and improved suspended ceiling fan assembly comprising: a housing having a central section in a generally dome-shaped configuration with a fist axis and with an external periphery formed as a square, the periphery including a wall extending from the periphery of the dome-shaped component and, at its end, inturned ledges in a rectangular configuration, the ledges adapted to be supported upon the periphery opening; a fan supported by the center of the housing and extending therefrom, the fan having a motor with a circular cross-section about an axis of rotation coincident with the axis of the housing, the fan including a plurality of blades secured to the motor for rotation in a plane about the axis of rotation of the motor; and a plurality of louvers to spread out air forced outwardly by the rotation of the fan blades.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
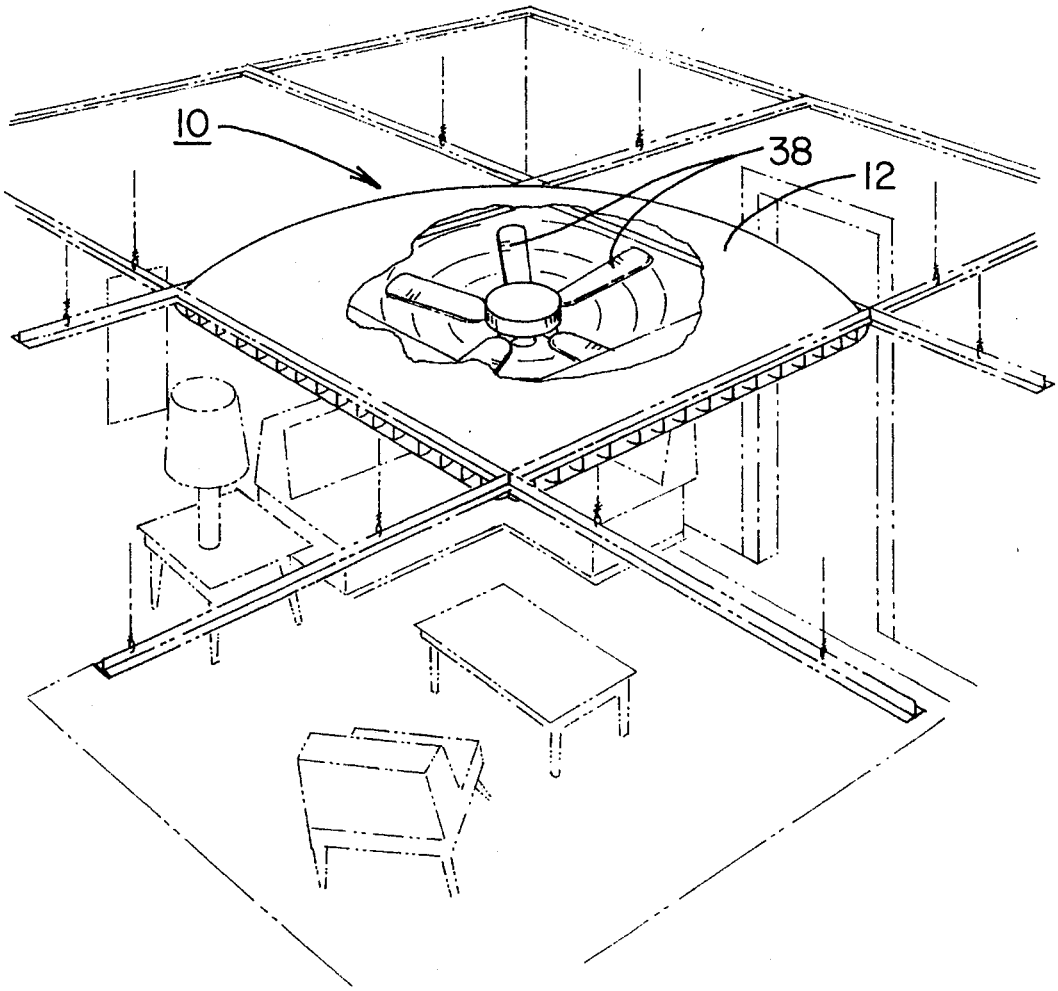
FIG. 1 is a perspective view with parts broken away to show certain internal constructions of the preferred embodiment of the new and improved suspended ceiling fan constructed in accordance with the principles of the present invention.
Figure 2:
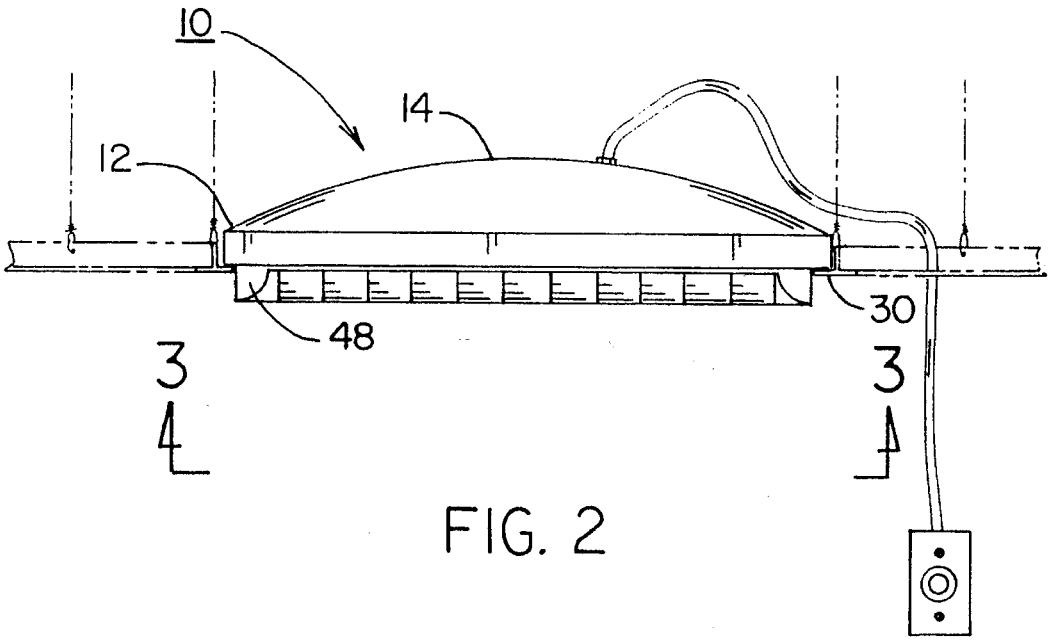
FIG. 2 is a side elevational view of the ceiling fan shown in FIG. 1.
Figure 3:
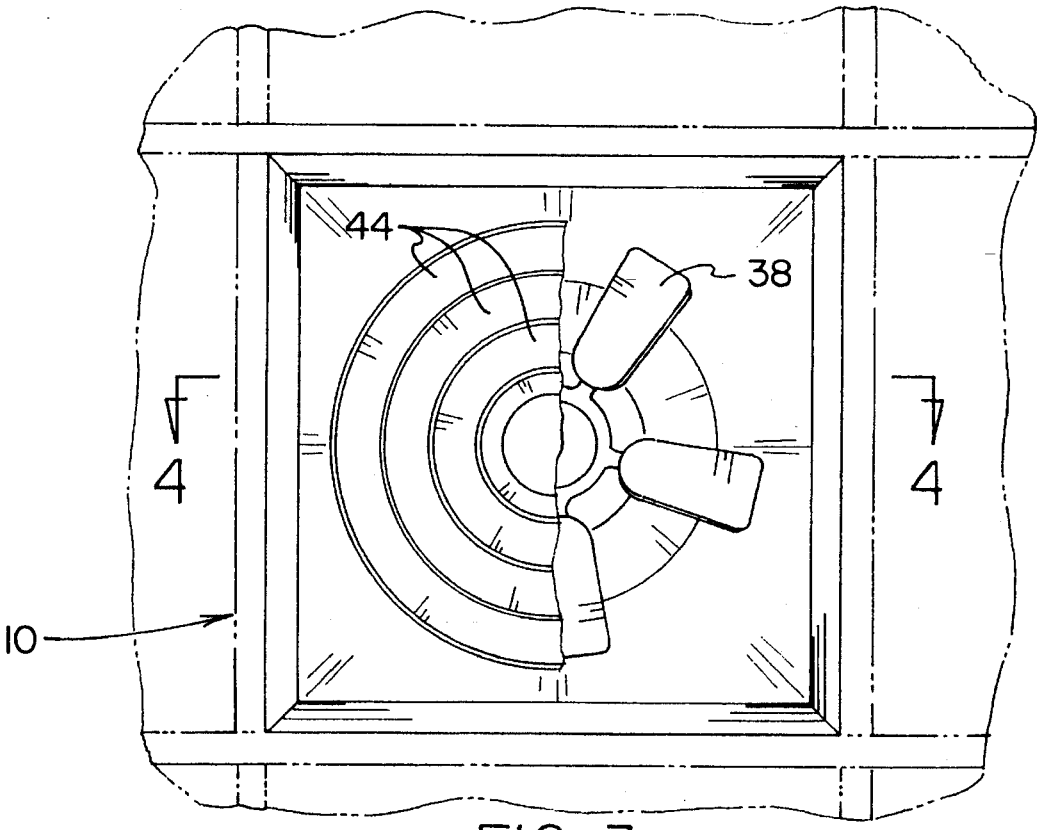
FIG. 3 is a bottom elevational view of the ceiling fan shown in FIGS. 1 and 2.

With reference now to the drawings, and in particular to FIG. 1 thereof, the preferred embodiment of the new and improved suspended ceiling fan embodying the principles and concepts of the present invention and generally designated by the reference numeral 10 will be described.

The present invention, the new and improved suspended ceiling fan, is comprised of a plurality of components. Such components include a housing, a fan, louvers and ribs. Such components are individually configured and correlated with respect to each other so as to attain the desired objective.

The central component of the system 10 of the present invention is a housing 12. The housing has an upper central section 14. The central section is in a generally dome-shaped configuration. Its central section 16 is higher than its peripheral sections 18. The central section has a vertical axis 20. It also has an external periphery formed as a square in the preferred embodiment. Such periphery may take the shape of a rectangle when used for being supported in two panels of a drop ceiling.

The periphery includes a vertical wall 24. Such wall extends downwardly from the periphery of the central section. The periphery has a lower end 26 which is turned internally to form horizontal ledges 28. Such ledges are in a rectangular configuration. They are adapted to be supported upon the peripheral opening 30 of one panel of a drop ceiling or suspended ceiling as they are sometimes called.

Figure 4:
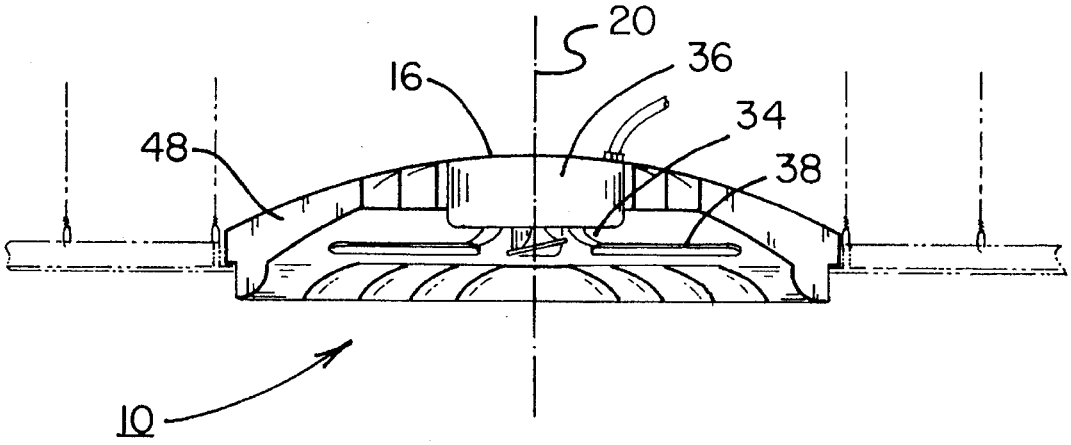
FIG. 4 is a cross-sectional view taken along line 4—4 of FIG. 3.
Figure 5:
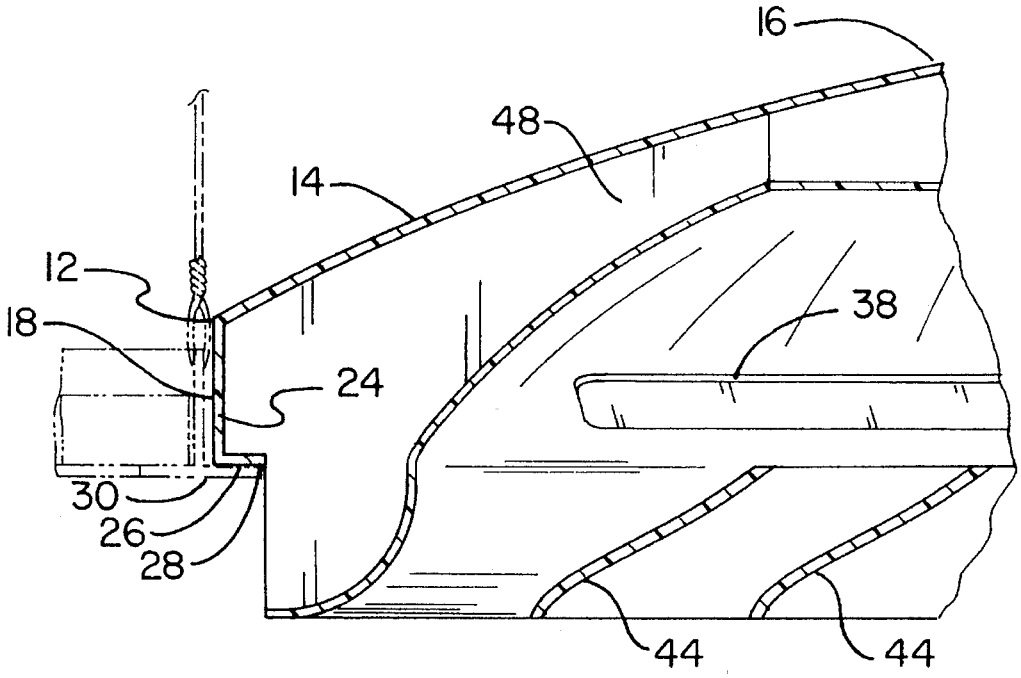
FIG. 5 is an enlarged cross-sectional view of one end portion of the fan shown in FIG. 4.

The next component of the system 10 is a fan 34. The fan is supported from the central section of the housing and its extends downwardly therefrom. Note FIG. 4. The fan has a motor 36 with blades 38. The motor in turn has a circular cross-section about the vertical axis of the dome-shaped central section of the housing. The axis of rotation of the fan and motor is coincident with the axis of the housing.

The fan also includes a plurality of blades 38. The blades are secured to the motor for rotation in a horizontal plane. The axis of rotation of the blades is coincident with the axis of rotation of the motor.

Next provided are a plurality of circular louvers 44. Such louvers are axially outward from the central section of the housing. The louvers are formed with curvatures curved about the axis of rotation. They are located beneath the housing to spread out air forced downwardly by the rotation of the fan blades.

Lastly provided are a plurality of radially extending ribs 48. The ribs are planar members and are vertically disposed. They are coupled between the motor and the periphery of the housing. The ribs define beneath the housing a path of travel for air. Such path of travel extends from the room where it enters the region beneath the housing at the periphery of the housing. After entering, the air is moved to a location above the fan blades being drawn therein by forces generated by the rotating blades. Thereafter, the air is blown downwardly by the fan blades. It passes through the louvers into the room therebeneath. This is done in an air recirculation mode during operation and use of the fan.

Figure 6:
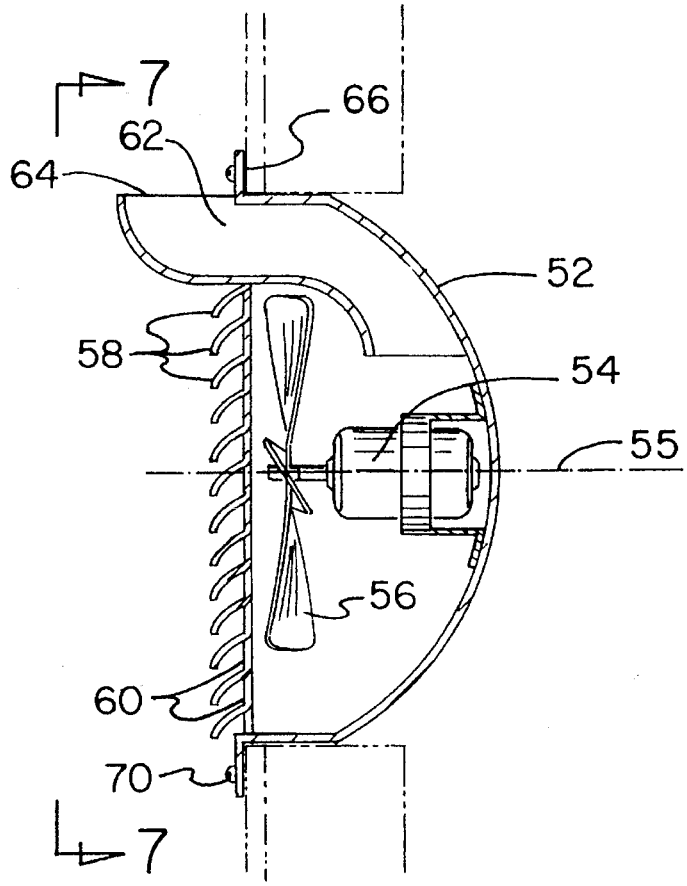
FIG. 6 is a cross-sectional view taken centrally through the housing of a fan constructed in accordance with an alternate embodiment of the invention.
Figure 7:
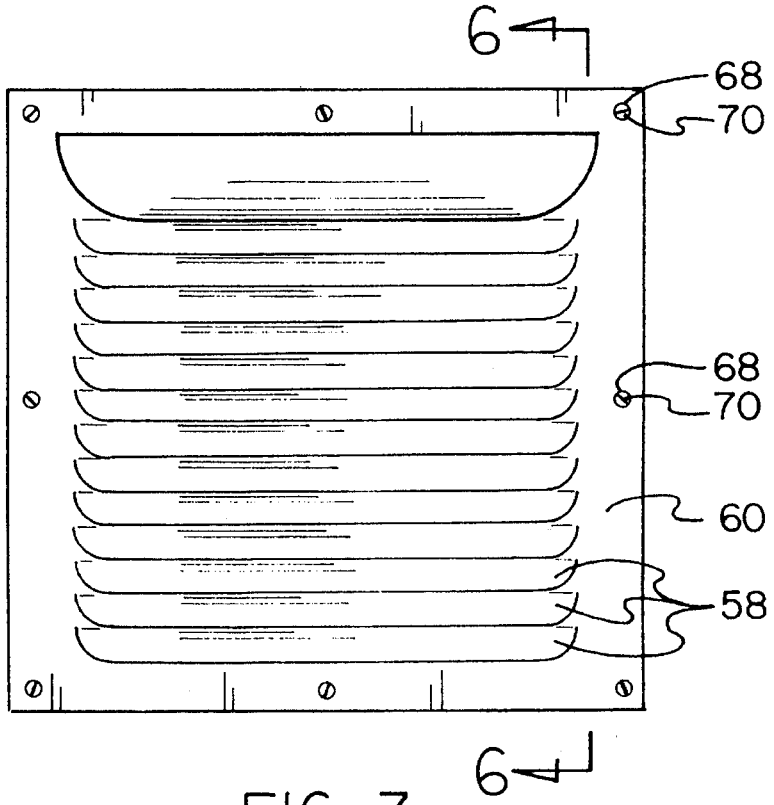
FIG. 7 is a front elevational view of the fan shown in FIG. 6.

An alternate embodiment of the invention is shown in FIGS. 6 and 7. In such embodiment, the fan is provided with a dome-shaped housing 52. The housing supports the motor 54. The motor is mounted for rotation about a horizontal axis 55. Consequently, the blades 56 being secured to the motor rotate in a vertical plane. Adjacent to the blades for directing the air moved by the blades are a plurality of louvers 58. The louvers have apertures 60 therebetween. This allows for the directing of air from the fan in a downward direction into the room to be cooled by the air. The periphery of the housing has one channel 62 adjacent to the upper edge. This constitutes an inlet opening 64 for air from the room to be recirculated. The channel directs the air from the room into the region adjacent to the motor behind the fan. Thereafter it is blown by the forces of the fan through the louvers into the room. This is done in a continuous and automatic cycle of operation when the motor is energized to rotate the fan blades. Plate 66 is secured adjacent to its periphery to the wall where its apertures 68 receive screws 70 for proper securement in position for operation and use.

Ceiling fans have become an increasingly popular way to create low cost heating and cooling. However, the design of most ceiling fans does not allow them to be installed in most rooms with low or suspended ceilings. The present invention is a new type of ceiling fan, and is made specifically for use with drop or low ceilings.

The present invention is designed so that it can be installed in a drop ceiling without changing the appearance of the ceiling. It consists of a fan with amounting mechanism, an inset, and a control panel. The inset is made in two sizes, 2 feet×2 feet and 2 feet×4 feet, so that it will fit the same size opening normally required by a ceiling tile. The inset is concave so that the fan is mounted up inside it and does not hang down below the ceiling tiles. It not only holds the fan but also covers the place in the old ceiling that would ordinarily be covered by the ceiling tile. Its special design includes four vents, one in each side, which help to circulate the air. The air is drawn in through the vents, up over the top of the fan, and blown back into the room. The fan's control panel works like a light dimmer switch. With it, the fan can be turned on and off and the speed of the fan can be controlled. The panel also contains a switch to change the direction of the fan.

The present invention is easy to install. Simply remove ceiling tile, and provide additional support to the track by running a wire from it to the old ceiling. Insert the inset and the fan, and connect the fan's control panel to the nearest electrical power source. The unit can also be used in rooms with ceilings too low for traditional ceiling fans. With the present invention, anyone who has a room with a drop ceiling or a low ceiling can enjoy the heating and cooling advantages of a ceiling fan.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved suspended ceiling fan assembly comprising, in combination:

a housing having an upper central section in a generally dome-shaped configuration with a vertical axis and an external periphery formed as a square, the periphery including a vertical wall extending downwardly from the periphery of the central section and, at a lower end of the vertical wall, inwardly turned ledges in a rectangular configuration, the ledges supported upon a peripheral opening of a panel in a drop ceiling;

a fan supported by a center of the housing and extending downwardly therefrom, the fan having a motor with a circular cross-section about a vertical axis of rotation coincident with the axis of the housing, the fan including a plurality of blades secured to the motor for rotation in a horizontal plane about the axis of rotation of the motor;

a plurality of circular louvers positioned axially outwardly from the central section of the housing with the louvers beneath the housing to spread out air forced downwardly by the rotation of the fan blades; and a plurality of radially extending vertically disposed planar ribs coupled between the motor and the periphery of the housing to define beneath the housing a path of travel for air from a room to enter and move to a location above the fan blades for being blown outwardly by the fan blades into the room therebeneath in an air recirculation mode.

2. A suspended fan assembly comprising:

a housing having a central section in a generally dome-shaped configuration with a first axis and with an external periphery formed as a square, the periphery including a wall extending from the periphery of the central section and, at a lower end of the wall, inwardly turned ledges in a rectangular configuration, the ledges supported upon a peripheral opening;

a fan supported by a center of the housing and extending therefrom, the fan having a motor with a circular cross-section about an axis of rotation coincident with the axis of the housing, the fan including a plurality of blades secured to the motor for rotation in a plane about the axis of rotation of the motor; and a plurality of louvers to spread out air forced outwardly by the rotation of the fan blades.

3. The assembly as set forth in claim 2 wherein the motor is mounted about a vertical axis, the louvers are circular and further including:

a plurality of radially extending vertically disposed planar ribs coupled between the motor and the periphery of the housing to define a path of travel for air from a room to enter and move to a location above the fan blades for being blown downwardly in the fan blades in a mode of recirculation.

* * * * *